US005226650A

United States Patent [19]

Suttner

[11] Patent Number: 5,226,650

[45] Date of Patent: Jul. 13, 1993

[54] TENNIS RACKET

[76] Inventor: Wolfgang Suttner, Dunlopstrasse 21, 4800 Bielefeld 11, Fed. Rep. of Germany

[21] Appl. No.: 577,362

[22] Filed: Sep. 5, 1990

[30] Foreign Application Priority Data

Sep. 5, 1989 [DE] Fed. Rep. of Germany ..... 3929459

[51] Int. Cl.[5] ..... A63B 49/08

[52] U.S. Cl. ..... 273/73 J; 73/379.03

[58] Field of Search ..... 273/73 J, 75, 72 R, 273/81 R, 29 A, 26 B, 183 D, 186 A; 272/68

[56] References Cited

U.S. PATENT DOCUMENTS

| | | | |
|---|---|---|---|
| 3,111,322 | 11/1963 | English | 273/193 R |
| 3,323,367 | 6/1967 | Searle | 73/172 |
| 3,918,721 | 11/1975 | Trask | 273/186 A |
| 3,995,492 | 12/1976 | Chynes | 272/DIG. 5 |
| 4,027,879 | 6/1977 | Wright | 273/29 |
| 4,138,118 | 2/1979 | Budney | 273/186 A X |
| 4,729,560 | 3/1988 | Cho | 272/68 X |
| 4,749,183 | 1/1988 | Cho | 273/68 X |
| 4,834,376 | 5/1989 | Steinberg | 273/186 A X |
| 4,930,785 | 6/1990 | Mills | 273/183 D |
| 4,971,320 | 11/1990 | Nesbit | 273/73 J X |

FOREIGN PATENT DOCUMENTS

| | | | |
|---|---|---|---|
| 1405857 | 6/1988 | U.S.S.R. | 273/73 J |

*Primary Examiner*—William H. Grieb
*Assistant Examiner*—William E. Stoll
*Attorney, Agent, or Firm*—Sixbey, Friedman, Leedom & Ferguson

[57] ABSTRACT

A tennis racket with a handle (4), preferably wrapped with a grip strip (3), which improves training of gripping techniques through the use of a sensor (6) that is incorporated into the handle (4), by which it is possible to measure the gripping force with which the hand of a tennis player wielding the tennis racket grips handle (4). Sensor (6) is connected to an electronic evaluation circuit (7) which is integrated into the handle, so that an indicator signal, especially an acoustic indicator signal, is caused to be emitted by the evaluation circuit (7) when a determined preadjustable limiting value or different limiting values of the gripping force is reached.

14 Claims, 2 Drawing Sheets

Fig. 2
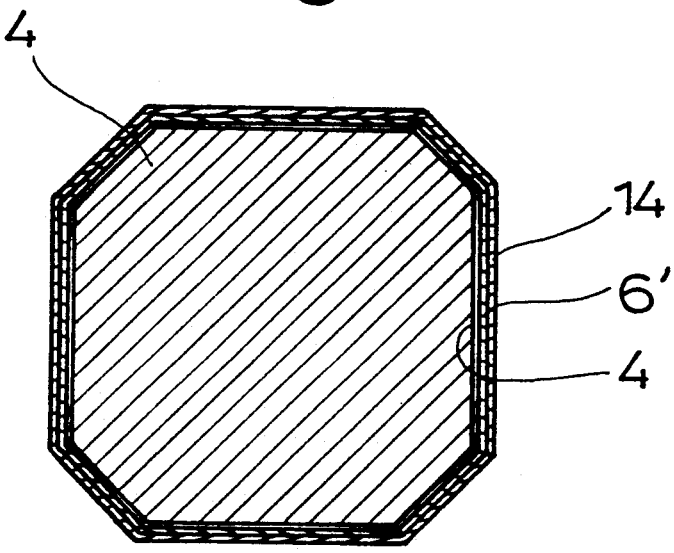
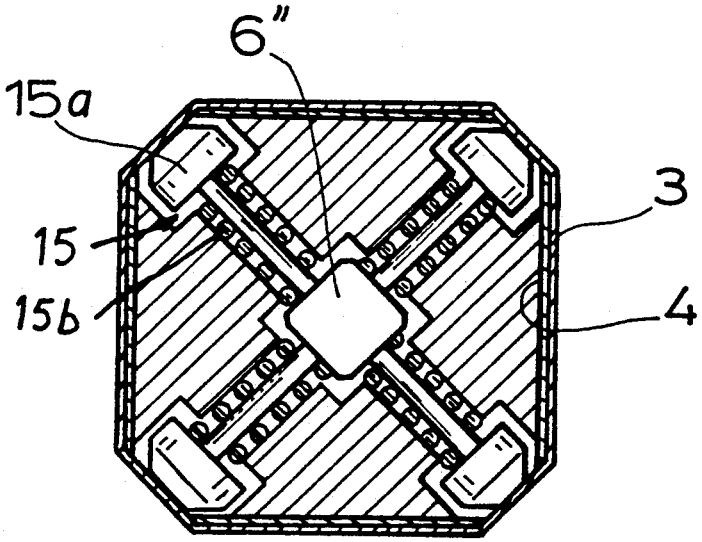
Fig. 3

TENNIS RACKET

BACKGROUND OF THE INVENTION

The invention relates to a tennis racket with a handle, which preferably is wrapped with a grip strip.

A tennis racket, normally consisting of a frame, strings and handle, is normally gripped by the hand of a tennis player with a certain gripping force. For an optimal stroke position and stroke control a minimum gripping force on the handle is necessary. Almost all tennis players have difficulties in always keeping the gripping force high enough, especially in the instant immediately preceding the impact of a tennis ball on the strings, often the gripping force decreases for a short time out of a "startle" reaction, a point in time when the grip it has to be sufficiently high. By video recordings and other observation techniques, an effort is made to teach tennis players how, in a tennis game, to manage to always hold the tennis racket firmly enough, i.e., hold the handle of the tennis racket with sufficient gripping force. These methods are expensive and not very successful.

By itself a tennis racket is known (U.S. Pat. No. 4,027,879), in which metal parts are provided, which as a function of the gripping force shift and mechanically strike one another, if the gripping force is high enough. In practice, however, it has turned out that this form of a gripping force indication is not reliable and, consequently, does not lead to real training results. Actually, such a gripping force indication often is not heard or the gripping force changes so slowly, that nothing at all is heard, since the impact pulse of the metal parts which depends only on the rate of change of the gripping force, is too small.

SUMMARY OF THE INVENTION

The primary object of the present invention is, thus, to further configure a tennis racket with the aim of achieving a particularly simple and successful course of training.

The invention achieves the above object in that a sensor is incorporated within the handle, by which it is possible to measure the gripping force with which the hand of a tennis player wielding the tennis racket clasps the handle. In particular, the sensor is integrated into the handle so that, when a determined preadjustable limiting value (or different limiting values) of the gripping force is attained, an indicator signal, especially an acoustic indicator signal, is issued by an acoustic signal emitter. Thus, according to the invention, an acoustic indicator of the gripping force is integrated into the tennis racket. An acoustic indicator signal is especially suitable, since it can be perceived under all playing conditions.

First, it is advisable to make the acoustic indicator signal sound if the gripping force exceeds a preset limiting value. This corresponds particularly well to the course of the play, inasmuch as a sufficient gripping force has to be present precisely when the stroke is made. Thus, it is not necessary to continuously grasp the racket with sufficient gripping force since the acoustic indication will indicate if sufficient gripping force was reached before making the stroke.

On the other hand, it can be advisable to make the indicator signal sound if the gripping force falls below the preset limiting value. Then, the indicator signal does not sound in the normal case and sounds only in case of error. Thus, the indicator signal has the character of a genuine alarm signal that is especially advantageous for gaining the attention of the tennis player.

Different configurations and further developments in accordance with the invention are described in greater detail below in conjunction with the accompanying figures of the drawings.

BRIEF DESCRIPTION OF THE DRAWINGS

FIG. 2 is a bottom end view of the handle, diagrammatically and partially in section, of another embodiment of a tennis racket according to the invention; and FIG. 3 is view, similar to that of FIG. 2, of a third embodiment of a tennis racket.

DETAILED DESCRIPTION OF THE PREFERRED EMBODIMENT

Figure 1:
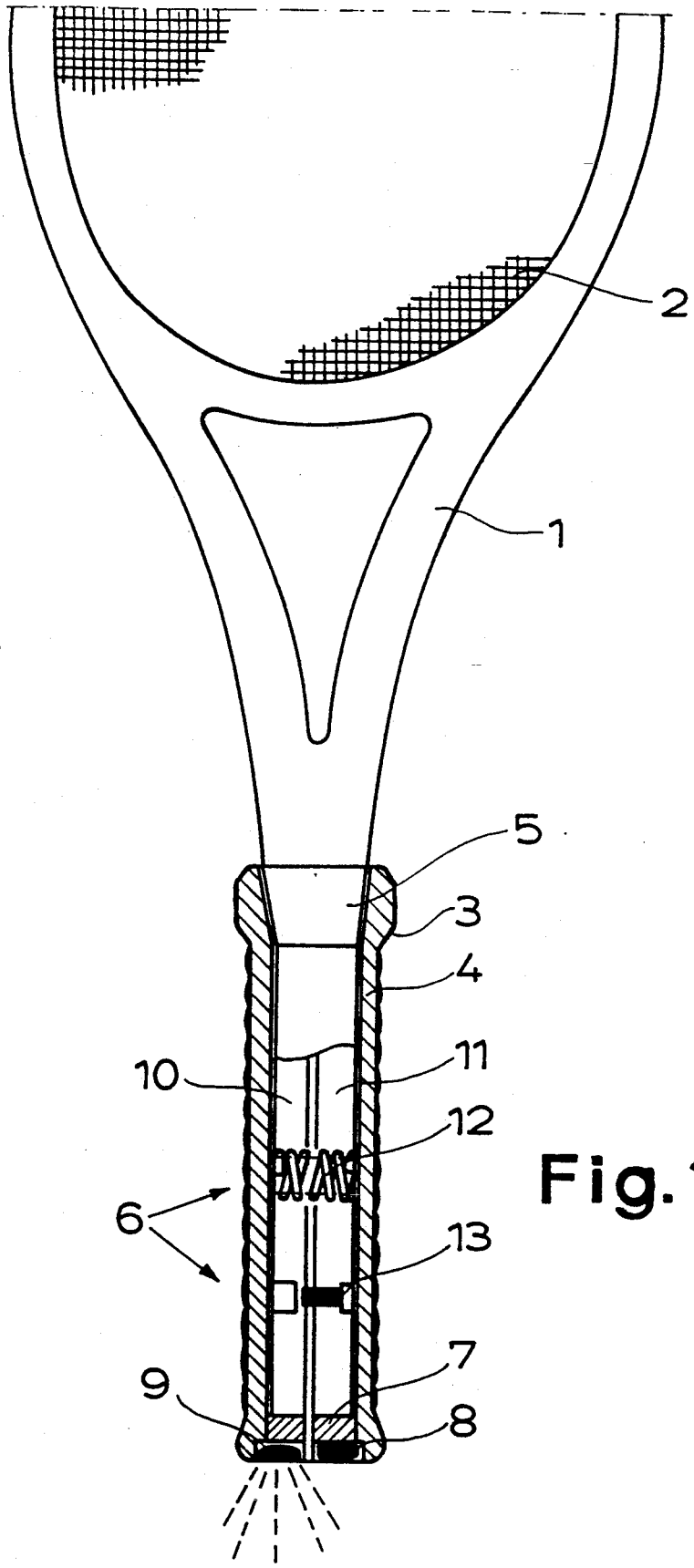
FIG. 1 is a partial longitudinal sectional view of a preferred embodiment of a tennis racket according to the invention.

The tennis racket represented in FIG. 1 has a frame 1 which is configured in the usual shape, to which strings 2 are attached as is conventional. Further, the tennis racket has a handle 4, made of one piece with frame 1, and shown, here, wrapped with a grip strip 3. It can be seen that handle 4 is comprised of a core 5 on which a multipiece plastic grip section which, in this case, is formed of two pieces 10, 11 which are wrapped with grip strip 3.

It is essential that a sensor 6 be incorporated in handle 4, by which it is possible to measure the gripping force with which the hand of a tennis player wielding the tennis racket clasps handle 4, that sensor being connected to an electronic triggering circuit 7 which is also integrated into 4. When a determined preadjustable limiting value (or different limiting values) of the gripping force is reached, an indicator signal, especially an acoustic indicator signal, is issued by an acoustic signature emitter 8.

In the embodiment represented, the determined limiting value of the gripping force can be preset, i.e., is variably adjustable and an acoustic signal sounds, if the gripping force falls below the preset limiting value. As soon as the gripping force decreases and falls below the preset limiting value, the signal makes the tennis player aware that it is necessary to more firmly grasp handle 4 of the tennis racket. Thus it is guaranteed that a tennis player is reminded time and again of a sufficiently firm gripping of handle 4 of this tennis racket. On the other hand, the indicator signal could also be sounded, if the 1 gripping force exceeds the preset limiting value, which would have the advantages explained above. As those skilled in the art will recognize, for this purpose, any conventional microchip comparator or logic circuit can serve as the triggering circuit 7, which triggers acoustic signal emitter 8 when the pressure value represented by the signal from the sensor is below (or alternatively, above) a stored value.

The embodiment represented in FIG. 1 shows an electronic triggering circuit 7 incorporated only as a platelike or disklike part in the bottom end of handle 4 since the details of such a circuit are known per se and by itself forms no part of this invention. Also incorporated in the bottom end in a manner that is accessible from the outside, is a receiving compartment for a button-like dry cell or other battery 8 for use as an energy source for triggering circuit 7 of sensor 6. It would also be possible to operate With a buffer battery and solar cells, the latter applied to the central (throat) area of frame 1.

An acoustic signal transmitter 9 is shown on the front, for example, in the form of a modern piezospeaker. As shown in broken lines, acoustic indicator signal sounds are being issued since, as the figure shows, a zero gripping force is present on handle 4, i.e., the gripping force falls below the preset limiting value. Of course, a deactivating switch (not shown) would be provided in such a case, so that the signal would not be continuously issued when the racket is not in use, or is put down between games or sets or to pick up balls, etc. Alternatively, such deactivation could be triggered automatically whenever the gripping force drops to zero since such indicates that the racket is, at least temporarily, not in use for play.

As noted above, in the embodiment represented in FIG. 1, handle 4 is made up of two half shells 10, 11. At least one spring element 12, and preferably several spring elements, is/are placed in the handle 4 so as to press the half shells 10, 11 apart. Several distributed spring elements 12 would have the advantage that the counterforces, applied by spring elements 12 and working against the gripping force, would be more evenly distributed over the length of handle 4. Further, the represented embodiment shows that, in this case, core 5 of handle 4 consists of two parts, at least in the lower area of handle 4.

Spring element 12 forms a part of sensor 6 in the represented embodiment, namely, the part of sensor 6 which is adjustable to the desired limiting value. For this purpose, in the embodiment represented here the tension of spring element 12 is adjustable, for example, by an appropriate change of an initial stressing force.

In the above-explained connection, for the version of the tennis racket represented in FIG. 1, it is noted that the sensor 6 has a contact 13 which triggers issuance of the actual signal when contact with an opposing contact element 13*a* is broken under action of springs 12 when pressure on the handle is released. On the other hand compression of the two half shells 10, 11 of handle 4 with sufficient gripping force, the contact surfaces of contact 13 and opposing contact element 13*a* into engagement with one another, so that a switch signal is released. This serves in the embodiment represented here to cut off the acoustic indicator signal emitted by emitter 9, and could, of course, also be used for the exactly opposite switch function.

The embodiment represented in FIG. 2 shows an alternative, which is characterized in that the handle is made in one-piece but with an elastic outside jacket 14. It corresponds to the fact that, in this embodiment, sensor 6'0 is made as a large-surface, pressure-sensitive element, for example, as a foil strain gage that can be applied, by itself, lying flat on handle 4. Alternatively, a hydraulic or pneumatic gripping force transducer could be used.

FIG. 3 clearly shows another alternative embodiment. In this case, like that of FIG. 2, handle 4 is made in one piece, but a spring element 15 is placed in each of the four corners of handle 4 and these spring elements 15 act on a central sensor 6'' or each spring element 15 acts on its own sensor 6''. Central sensor 6, in FIG. 3, can be a pressure-sensitive element, for example, a piezocrystal or an arrangement of piezocrystals. Each spring element 15, comprises a movable body 15*a* and a compression spring 15*b*, and is incorporated into handle 4 so that it movable body 15*a* is pushed outward by spring 15*b* up to a stop. With sufficient gripping force, the movable body 15*a* of spring element 15 is pressed inward against the resistance of spring 15*b* and sensor 6 is activated. Thus, it is sufficient if the gripping force exceeds the preset limiting value on a spring element 15 at any one of the four corners.

Other alternatives for sensors 6, 6', 6'' are capacitively operating signal releases, inductively operating signal releases, etc. Which type of triggering sensor in particular is selected depends on the particular configuration of the tennis racket. Additionally, sensor 6, 6', 6'', as provided according to the invention, could applied as a retrofitted element for existing tennis rackets; but, technically, in most cases, a specially constructed tennis racket would be a better alternative.

I claim:

1. Tennis racket with a handle upon which a grip covering is applied, comprising a sensor incorporated into the handle and forming a means for measuring a gripping force with which the handle is grasped by hand of a tennis player wielding the tennis racket, said sensor being electronically connected to an acoustic signal emitter in the handle in a manner forming a means for emitting an acoustic indicator signal when at least one determined preadjustable limiting value of the gripping force is reached; wherein the handle is made up of two half shells between which at least one spring element is placed as a means for applying a force in a direction acting to press the half shells apart.

2. Tennis racket according to claim 1, wherein said signal emitter is a piezoelectric speaker.

3. Tennis racket according to claim 2, wherein the piezoelectric speaker is located at a bottom end of the handle.

4. Tennis racket according to claim 1, wherein the signal emitter is located at a bottom end of the handle.

5. Tennis racket according to claim 1, wherein the sensor comprises a contact which triggers emitting of the indicator signal when it breaks contact with an opposing contact element.

6. Tennis racket according to claim 1, wherein the sensor is a large-surface, pressure-sensitive foil strain gage element that is applied flat on the handle.

7. Tennis racket according to claim 1, wherein said sensor is operable for causing said a signal to be emitted by said signal emitting means when the gripping force falls below a predetermined value.

8. Tennis racket according to claim 1, wherein said sensor is operable for causing said a signal to be emitted by said signal emitting means when the gripping force exceeds a predetermined value.

9. Tennis racket according to claim 1, wherein said sensor is operable for causing said a signal to be emitted by said signal emitting means when the gripping force exceeds a predetermined value.

10. Tennis racket with a handle upon which a grip covering is applied, comprising a sensor incorporated into the handle and forming a means for measuring a gripping force with which the handle is grasped by a hand of a tennis player wielding the tennis racket, said sensor being electronically connected to an acoustic signal emitter in the handle in a manner forming a means for emitting an acoustic indicator signal when at least on determined preadjustable limiting value of the gripping force is reached; wherein the handle is made as one piece, wherein a spring element is place in each of four corners of the handle and wherein each spring element acts on the sensor which is centrally positioned within the handle.

11. Tennis racket according to claim 10, wherein the sensor is a large-surface, pressure-sensitive foil strain gage element that is applied flat on the handle.

12. Tennis racket according to claim 10, wherein the sensor is a large-surface, pressure-sensitive foil strain gage element that is applied flat on the handle.

13. Tennis racket according to claim 10, wherein said sensor is operable for causing said signal to be emitted by said signal emitting means when the gripping force falls below a predetermined value.

14. Tennis racket according to claim 10, wherein said sensor is operable for causing said a signal to be emitted by said signal emitting means when the gripping force exceeds a predetermined value.

* * * * *